US010037739B2

(12) United States Patent
Chang et al.

(10) Patent No.: US 10,037,739 B2
(45) Date of Patent: Jul. 31, 2018

(54) GATE DRIVING CIRCUIT, DISPLAY DEVICE AND GATE PULSE MODULATION METHOD

(71) Applicant: Fitipower Integrated Technology, Inc., Hsinchu (TW)

(72) Inventors: Li-Shen Chang, Hsinchu (TW); Chen-Chi Yang, Hsinchu (TW)

(73) Assignee: Fitipower Integrated Technology, Inc., Hsinchu (TW)

( * ) Notice: Subject to any disclaimer, the term of this patent is extended or adjusted under 35 U.S.C. 154(b) by 150 days.

(21) Appl. No.: 15/255,087

(22) Filed: Sep. 1, 2016

(65) Prior Publication Data

US 2017/0092215 A1 Mar. 30, 2017

(30) Foreign Application Priority Data

Sep. 25, 2015 (TW) ..... 104131898 A

(51) Int. Cl.
*G09G 3/36* (2006.01)
*G09G 3/00* (2006.01)

(52) U.S. Cl.
CPC ..... *G09G 3/3677* (2013.01); *G09G 3/006* (2013.01); *G09G 2300/0408* (2013.01); *G09G 2320/0247* (2013.01)

(58) Field of Classification Search
CPC ... G09G 2310/0264; G09G 2320/0223; G09G 3/3685; G09G 3/3688; G09G 3/3696
See application file for complete search history.

(56) References Cited

U.S. PATENT DOCUMENTS 8,149,025 B2 * 4/2012 Huang ..... G09G 3/3677 326/21
8,902,203 B2 * 12/2014 Hsu ..... G09G 3/3648 345/204
9,078,301 B2 * 7/2015 Li ..... H05B 37/02
9,419,603 B2 * 8/2016 Choi ..... H03K 17/165
9,449,711 B2 * 9/2016 Chien ..... G11C 19/28
9,524,691 B2 * 12/2016 Li ..... H05B 37/02
2011/0193833 A1 * 8/2011 Hsu ..... G09G 3/3648 345/204
2011/0273226 A1 * 11/2011 Huang ..... G09G 3/3677 327/538
2012/0169695 A1 * 7/2012 Chang ..... G09G 3/3648 345/211
2013/0234626 A1 * 9/2013 Li ..... H05B 37/02 315/360
2014/0145923 A1 * 5/2014 Chen ..... G09G 3/3677 345/94

(Continued)

FOREIGN PATENT DOCUMENTS

TW 201123128 7/2011
TW 201516995 5/2015

*Primary Examiner* — Patrick F Marinelli
(74) *Attorney, Agent, or Firm* — ScienBiziP, P.C.

(57) ABSTRACT

A gate driving and modulating circuit, for reduced flicker on a display, includes a first discharge circuit and a plurality of interconnected gate drivers. The plurality of gate drivers is electrically coupled to ground through the first discharge circuit. Each of the plurality of gate drivers includes a second discharge circuit. The gate driving circuit performs a chamfering of a gate signal by being simultaneously discharged through the first discharge circuit and the second discharge circuit.

19 Claims, 5 Drawing Sheets

(56) References Cited

U.S. PATENT DOCUMENTS

| | | | | |
|---|---|---|---|---|
| 2014/0219412 | A1* | 8/2014 | Chien | G11C 19/28 377/68 |
| 2014/0340291 | A1* | 11/2014 | Wang | G09G 3/3696 345/87 |
| 2015/0280700 | A1* | 10/2015 | Lai | G09G 3/3677 345/215 |
| 2015/0287377 | A1* | 10/2015 | Li | H05B 37/02 345/212 |
| 2017/0076657 | A1* | 3/2017 | Lu | G09G 3/2007 |
| 2017/0092215 | A1* | 3/2017 | Chang | G09G 3/006 |
| 2017/0213514 | A1* | 7/2017 | Xie | G09G 3/3266 |

* cited by examiner

GATE DRIVING CIRCUIT, DISPLAY DEVICE AND GATE PULSE MODULATION METHOD

FIELD

The subject matter herein generally relates to displays, and more particularly to a gate driving circuit, a gate pulse modulation method, and a display device implementing the gate driving circuit and gate pulse modulation method.

BACKGROUND

A thin film transistor display, such as a thin film transistor liquid crystal display (TFT-LCD), utilizes many thin film transistors, in conjunction with other elements, arranged in a matrix as switches for driving liquid crystal molecules to generate images. In general, a driving method of a TFT-LCD device uses a gate pulse signal to drive each pixel transistor for controlling on-off states of each pixel. However, the increasing size of the TFT-LCD device renders it more vulnerable to flicker. Therefore, there is room for improvement within the art.

BRIEF DESCRIPTION OF THE DRAWINGS

Implementations of the present technology will now be described, by way of example only, with reference to the attached figures.

DETAILED DESCRIPTION

Figure 1:
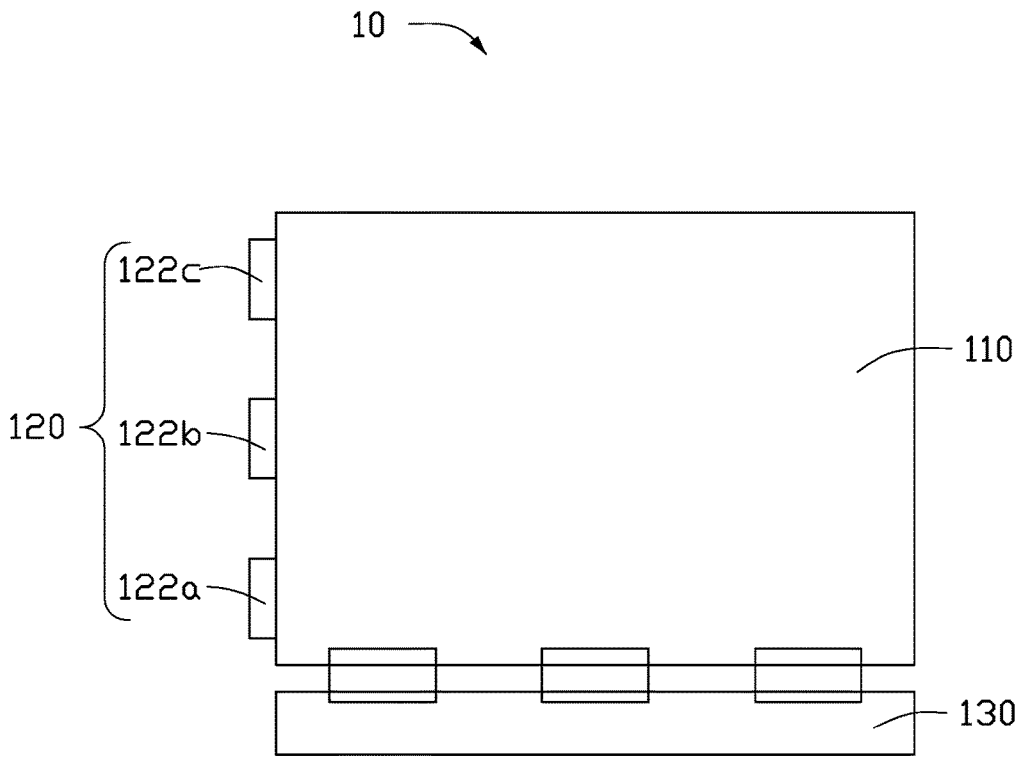
FIG. 1 is a schematic view of an exemplary embodiment of a display device employing a display panel, a gate driving circuit, and a data driver.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

FIG. 1 illustrates a display device 10 comprising a display panel 110, a gate driving circuit 120, and a data driver 130. The gate driving circuit 120 is electrically coupled to an edge of the display panel 110 by gate on array (GOA) technology. The data driver 130 is electrically coupled to another edge of the display panel 110 adjacent to the gate driving circuit 120. The gate driving circuit 120 can output a gate driving signal to the display panel 110. The data driver 130 can output a data driving signal to the display panel 110. The gate driving circuit 120 can comprise a plurality of gate drivers. In the illustrated embodiment, the gate driving circuit 120 comprises three gate drivers, 122*a*, 122*b*, and 122*c*. It should be understood that the number of gate drivers is not limited to three it can also be four or more. The plurality of gate drivers can be cascaded to each other by Wire On Array (WOA). Each of the plurality of gate drivers can drive an area of the display panel 110.

Figure 2:
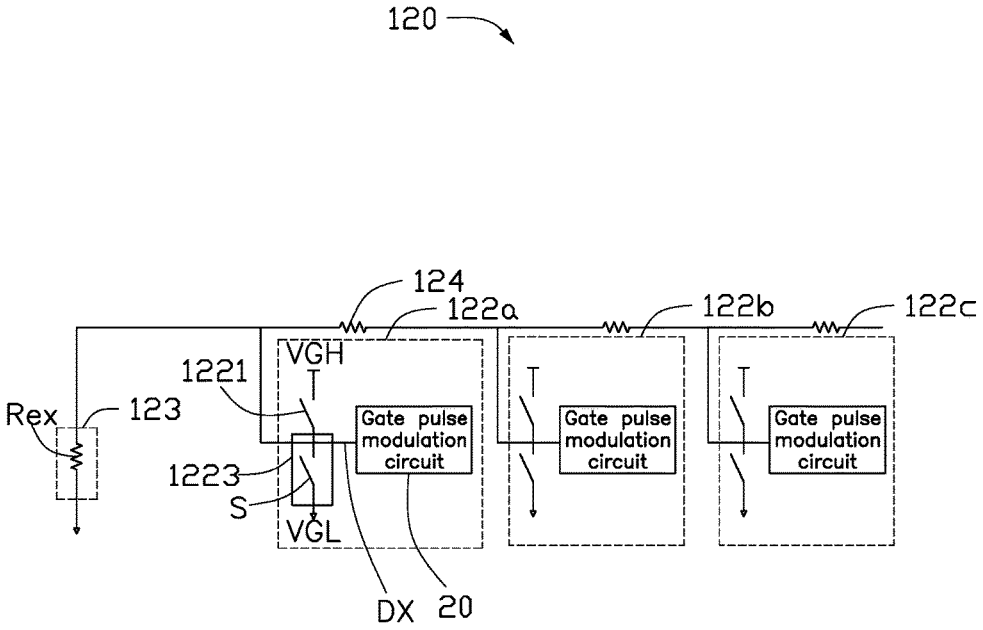
FIG. 2 is a circuit diagram of a circuit equivalent to the gate driving circuit of FIG. 1.

FIG. 2 illustrates the gate driving circuit 120 of FIG. 1. The gate driving circuit 120 further comprises a first discharge circuit 123. The first discharge circuit 123 can comprise a discharge resistor $R_{ex}$. An end of the discharge resistor $R_{ex}$ is electrically coupled to the plurality of gate drivers 122*a*, 122*b*, and 122*c*. The other end of the discharge resistor $R_{ex}$ is grounded. The plurality of gate drivers 122*a*, 122*b*, and 122*c* is electrically coupled to ground through the first discharge circuit 123.

Each of the plurality of gate drivers 122*a*, 122*b*, and 122*c* can comprise a discharge end DX, a gate pulse modulation circuit 20, a precharge switch 1221, and a second discharge circuit 1223. The precharge switch 1221 can be coupled between a gate turn-on voltage VGH and the discharge end DX. The second discharge circuit 1223 can be coupled between the discharge end DX and a gate turn-off voltage VGL. The second discharge circuit 1223 can comprise a discharge control switch S. When the gate driving circuit 120 performs a chamfering of the gate signal, the discharge control switch S is closed. In the illustrated embodiment, the discharge ends DX of the plurality of gate drivers 122*a*, 122*b*, and 122*c* are connected to each other through an electrically-conductive line. An equivalent resistance 124 is formed by the electrically-conductive line between two adjacent discharge ends DX of the plurality of gate drivers. When the gate driving circuit 120 performs a chamfering of the gate signal, a resistance value of the second discharge circuit 1223 must exceed a resistance value of the first discharge circuit 123. In the illustrated embodiment, the resistance value of the second discharge circuit 1223 may be 12 kiloohms (kΩ) or 19 kΩ and the resistance value of the first discharge circuit 123 may be 4 kΩ.

Figure 3:
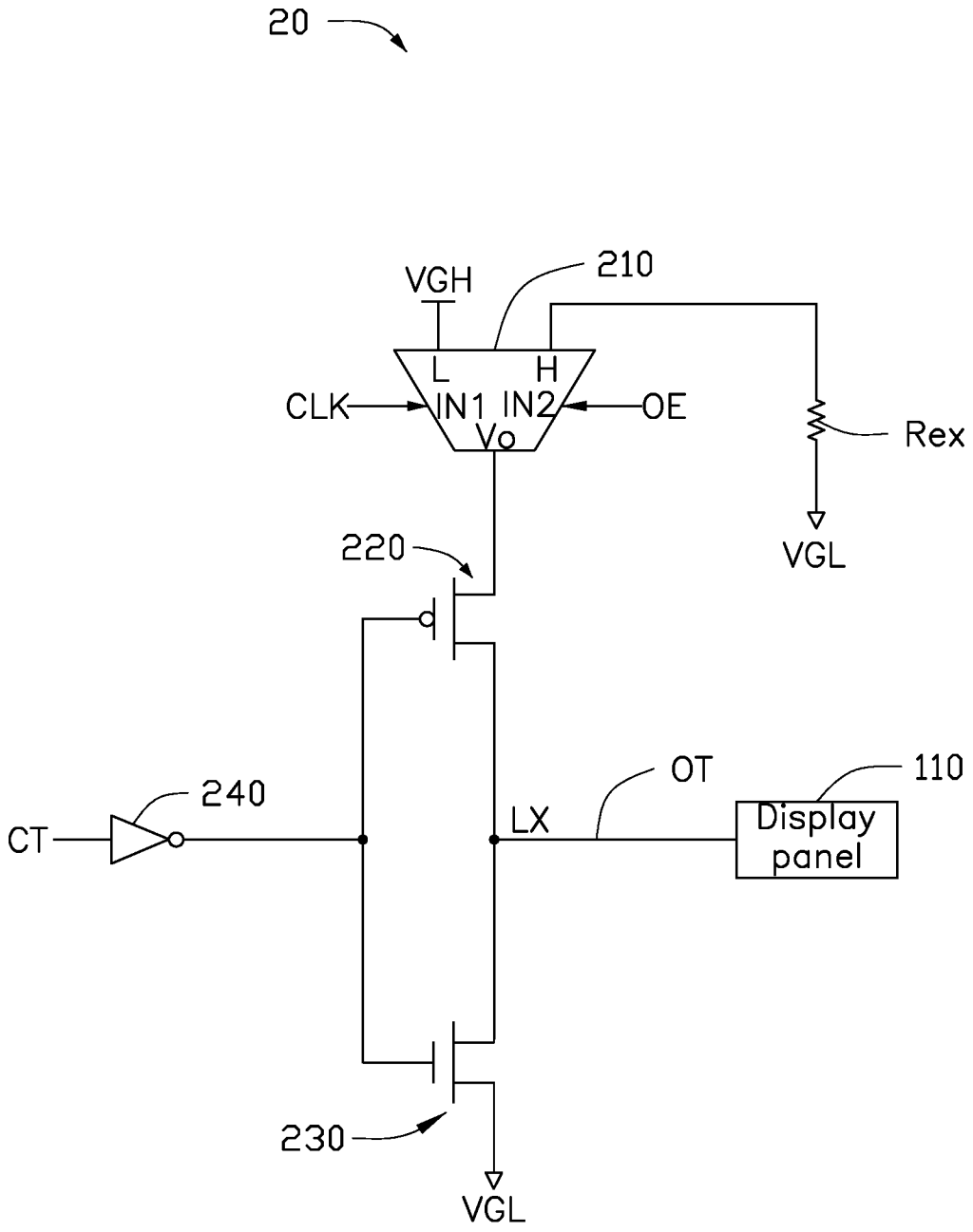
FIG. 3 is a circuit diagram of a gate pulse modulation circuit employed in the display device of FIG. 1.

FIG. 3 illustrates the gate pulse modulation circuit 20 of FIG. 2. The gate pulse modulation circuit 20 can output a gate driving voltage to the display panel 110. The gate pulse modulation circuit 20 can comprise an output terminal OT, a logic controller 210, an upper-bridge switch 220, a lower-bridge switch 230, and an inverter 240. The logic controller 210, the upper-bridge switch 220, and the lower-bridge switch 230 are serially connected between the gate turn-on voltage VGH and the gate turn-off voltage VGL. The inverter 240 can receive a turn-on control signal CT, and thus switch the upper-bridge switch 220 on and switch the lower-bridge switch 230 off. A node LX is between the upper-bridge switch 220 and the lower-bridge switch 230. The node LX is coupled to the display panel 110 through the output terminal OT. The gate pulse modulation circuit 20 can output a gate pulse modulation signal to the display panel 110 through the output terminal OT.

The logic controller 210 can comprise a power input terminal L, a discharge output terminal H, a first control signal input terminal IN1, a second control signal input terminal IN2, and a power signal output terminal VO. The power input terminal L is coupled to the gate turn-on voltage VGH. The discharge output terminal H is coupled to the gate turn-off voltage VGL through the discharge resistor $R_{ex}$. The first control signal terminal IN1 can receive a clock signal CLK. The second control signal input terminal IN2 can receive an enable signal OE. The power signal output terminal VO can selectively output a gate voltage.

In the illustrated embodiment, the upper-bridge switch 220 is a P-metal oxide semiconductor (PMOS) transistor and the lower-bridge switch 230 is an N-metal oxide semiconductor (NMOS) transistor. A source of the upper-bridge switch 220 is coupled to the power signal output terminal VO. A drain of the upper-bridge switch 220 is coupled to a drain of the lower-bridge switch 230. A source of the lower-bridge switch 230 is grounded. A gate of the upper-bridge switch 220 and a gate of the lower-bridge switch 230 are coupled to the inverter 240. The node LX is between the drain of the upper-bridge switch 220 and the drain of the lower-bridge switch 230.

Figure 4:
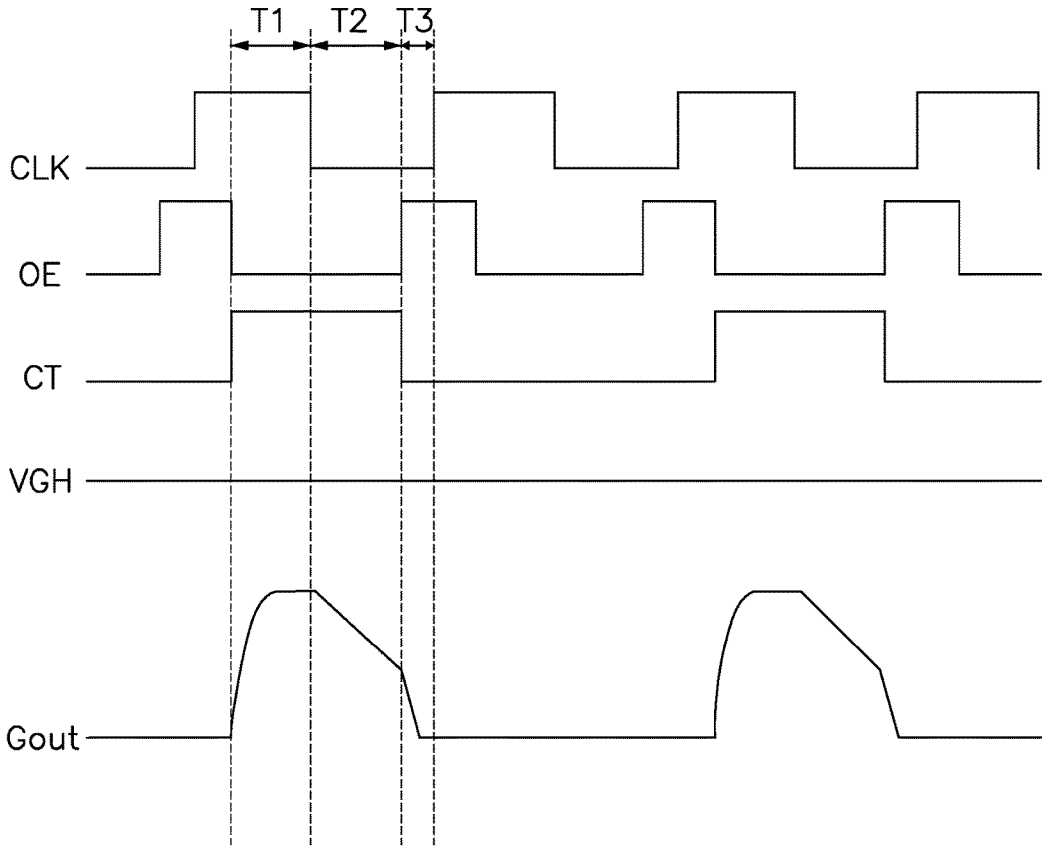
FIG. 4 shows operation sequence of the gate pulse modulation circuit of FIG. 3.

FIG. 4 illustrates the sequence of operation of the gate pulse modulation circuit 20 of FIG. 3. During a first period T1, the inverter 240 receives the turn-on control signal CT, thus switching the upper-bridge switch 220 on and switching the lower-bridge switch 230 off. In the illustrated embodiment, the inverter 240 switches the upper-bridge switch 220 on and switches the lower-bridge switch 230 off when the turn-on control signal CT is at logic-high. During the first period T1, the clock signal CLK is at logic-high and the enable signal OE is at logic-low. The logic controller 210 controls the power signal output terminal VO to connect to the power input terminal L and disconnects the discharge output terminal H. Thus, the gate turn-on voltage VGH can be outputted to the display panel 110 through the power signal output terminal VO, the upper-bridge switch 220, and the node LX. The gate pulse modulation circuit 20 outputs the gate pulse modulation signal Gout to the display panel 110 through the output terminal OT.

During a second period T2, the inverter 240 receives the turn-on control signal CT, and switches the upper-bridge switch 220 on and switches the lower-bridge switch 230 off. In the illustrated embodiment, it is the inverter 240 which switches the upper-bridge switch 220 on and switches the lower-bridge switch 230 off when the turn-on control signal CT is at logic-high. During the second period T2, the clock signal CLK and the enable signal OE are at logic-low. The logic controller 210 connects the power signal output terminal VO to the discharge output terminal H and disconnects the power input terminal L. Thus, the display panel 110 is discharged through the upper-bridge switch 220, the discharge output terminal H, and the discharge resistor $R_{ex}$. The gate pulse modulation signal $G_{out}$ has a chamfered falling edge in that period.

During a third period T3, the enable signal OE is at logic-high and the turn-on control signal CT is at logic-low. The inverter 240 receives the turn-on control signal CT, and switches the upper-bridge switch 220 off and switches the lower-bridge switch 230 on. Thus, the display panel 110 is discharged through the lower-bridge switch 230.

A method of separation of variables can analyze the first discharge circuit 123 and the second discharge circuit 1223. When the discharge control switch S of the second discharge circuit 1223 is opened, a resistance value of the discharge resistor $R_{ex}$ may be 4 kΩ. Thus, the plurality of gate drivers 122*a*, 122*b*, and 122*c* is discharged through the first discharge circuit 123. An equivalent resistance of the second discharge circuit 1223 is R1. An equivalent resistance of the first discharge circuit 123 is R2. The gate pulse modulation signals outputted by the gate drivers 122*a*, 122*b*, and 122*c* are G1, G2, and G3 respectively. A resistance value of the equivalent resistance 124 may be 160Ω. The calculated values are listed in Table 1.

TABLE 1

| | G1 | G2 | G3 | R1 | R2 | 16V/R2 | Gn/G3 | G(n − 1) − Gn |
|---|---|---|---|---|---|---|---|---|
| G3 | ∞ | ∞ | ∞ | ∞ | 4570 | 3501.09 uA | 100% | 3.63% |
| G2 | ∞ | ∞ | ∞ | ∞ | 4410 | 3628.12 uA | 103.63% | 3.90% |
| G1 | ∞ | ∞ | ∞ | ∞ | 4250 | 3764.71 uA | 107.53% | — |

When the discharge control switch S of the second discharge circuit 1223 is closed, the resistance of the discharge resistor $R_{ex}$ may be infinite. Thus, the plurality of gate drivers 122*a*, 122*b*, and 122*c* is discharged through the second discharge circuit 1223. The equivalent resistance of the second discharge circuit 1223 is R1. The equivalent resistance of the first discharge circuit 123 is R2. The gate pulse modulation signals outputted by the gate drivers 122*a*, 122*b*, and 122*c* are G1, G2, and G3 respectively. The resistance value of the equivalent resistance 124 may be 160Ω. The calculated values are listed in Table 2.

TABLE 2

| | G1 | G2 | G3 | R1 | R2 | 16V/R2 | Gn/G3 | G(n − 1) − Gn |
|---|---|---|---|---|---|---|---|---|
| G3 | 12480 | 12320 | 12000 | 4087.8 | 4087.8 | 3914.09 uA | 100% | 1.3% |
| G2 | 12160 | 12000 | 12160 | 4035.4 | 4035.4 | 3964.91 uA | 101.3% | −1.3% |
| G1 | 12000 | 12320 | 12480 | 4087.8 | 4087.8 | 3914.09 uA | 100.% | — |

When the discharge control switch S of the second discharge circuit 1223 is closed, the resistance value of the discharge resistor $R_{ex}$ may be 4 kΩ. Thus, the plurality of gate drivers 122*a*, 122*b*, and 122*c* is discharged through the first discharge circuit 123 and the second discharge circuit 1223 simultaneously. The equivalent resistance of the second discharge circuit 1223 is R1. The equivalent resistance of the first discharge circuit 123 is R2. The gate pulse modulation signals outputted by the gate drivers 122*a*, 122*b*, and 122*c* are G1, G2, and G3 respectively. The resistance value of the equivalent resistance 124 may be 160Ω. The calculated values are listed in Table 3.

TABLE 3

| | G1 | G2 | G3 | R1 | R2 | 16V/R2 | Gn/G3 | G(n − 1) − Gn |
|---|---|---|---|---|---|---|---|---|
| G3 | 19646 | 19486 | 19166 | 6476.87 | 2679.43 | 5971.42 uA | 100% | 2.47% |
| G2 | 19326 | 19166 | 19326 | 6424.12 | 2614.92 | 6118.73 uA | 102.47% | 1.95% |
| G1 | 19166 | 19486 | 19646 | 6476.87 | 2566.14 | 6235.04 uA | 104.41% | – |

When the plurality of gate drivers 122*a*, 122*b*, and 122*c* is discharged through the first discharge circuit 123 and the second discharge circuit 1223 simultaneously, every two adjacent gate drivers 122*a*, 122*b*, and 122*c* has a reduced chamfered falling edge signal.

Figure 5:
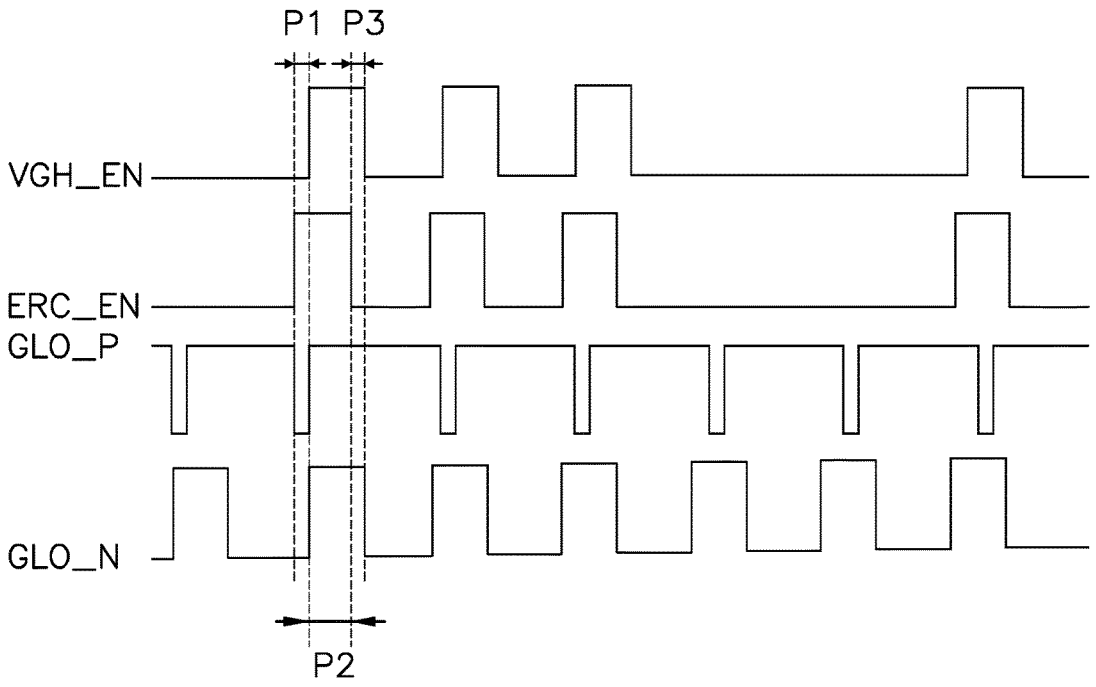
FIG. 5 shows operation sequence of the gate driving circuit of FIG. 2.

FIG. 5 illustrates an operation sequence of the gate driving circuit 120 of FIG. 2. During a first period P1, the precharge switch 1221 is closed by the gate driving circuit 120 when a first discharge control signal ERC_EN of the first discharge circuit 123 changes from a logic-low to a logic-high and a precharge control signal GLO_P of the precharge switch 1221 changes from a logic-high to a logic-low. Thus, the gate driving circuit 120 is discharged through the first discharge circuit 123 and the gate turn-on voltage VGH precharges a parasitic capacitance of the equivalent resistance 124. In the illustrated embodiment, the precharge switch 1221 is a PMOS transistor.

During a second period P2, the gate driving circuit 120 performs a chamfering of the gate signal when a control signal VGH_EN of the gate turn-on voltage VGH, a second discharge control signal GLO_N of the discharge control switch S, and the precharge control signal GLO_P change from a logic-low to a logic-high. Thus, the gate driving circuit 120 is discharged through the first discharge circuit 123 and the second discharge circuit 1223 simultaneously. In the illustrated embodiment, the second period P2 includes the second period T2.

During a third period P3, the first discharge control signal ERC_EN of the first discharge circuit 123 changes from logic-high to logic-low. Thus, the gate driving circuit 120 is discharged through the second discharge circuit 1223.

The gate driving circuit 120 performs the chamfering of the gate signal and is discharged through the first discharge circuit 123 and the second discharge circuit 1223 simultaneously, so that every two adjacent gate drivers 122*a*, 122*b*, and 122*c* has the reduced chamfered falling edge signal. Thus, image flicker can be effectively reduced.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims.

What is claimed is:

1. A gate driving circuit comprising:

a first discharge circuit;

a plurality of interconnected gate drivers, wherein the plurality of gate drivers is electrically coupled to ground through the first discharge circuit, and wherein each of the plurality of gate drivers comprises a second discharge circuit, coupled between a discharge end of each of the plurality of gate drivers and a gate turn-off voltage, and a gate pulse modulation circuit that outputs a gate signal; and wherein when the gate driving circuit performs a chamfering of the gate signal, the gate driving circuit is simultaneously discharged through the first discharge circuit and the second discharge circuits.

2. The gate driving circuit of claim 1, wherein a resistance value of the second discharge circuit exceeds a resistance value of the first discharge circuit.

3. The gate driving circuit of claim 1, wherein each of the plurality of gate drivers further comprises a precharge switch coupled between a gate turn-on voltage and the discharge end of each of the plurality of gate drivers.

4. The gate driving circuit of claim 3, wherein the plurality of interconnected gate drivers is through an electrically-conductive line.

5. The gate driving circuit of claim 4, wherein when the precharge switch is closed by the gate driving circuit, the gate driving circuit is discharged through the first discharge circuit and the gate turn-on voltage precharges a parasitic capacitance of an equivalent resistance formed by the electrically-conductive line between two adjacent discharge ends of the plurality of gate drivers.

6. The gate driving circuit of claim 1, wherein the second discharge circuit further comprises a discharge control switch, and wherein when the gate driving circuit performs the chamfering of the gate signal, the discharge control switch is closed.

7. The gate driving circuit of claim 1, wherein the plurality of gate drivers is cascaded to each other by Wire On Array (WOA).

8. The gate driving circuit of claim 1, wherein the first discharge circuit further comprises a discharge resistor coupled between the plurality of gate drivers and the ground.

9. A gate pulse modulation method, the method comprising:

performing a chamfering of a gate driving signal; and outputting the gate driving signal;

wherein the gate driving circuit comprises a first discharge circuit and a plurality of interconnected gate drivers, wherein the plurality of gate drivers is electrically coupled to ground through the first discharge circuit, wherein each of the plurality of gate drivers comprises a second discharge circuit, coupled between a discharge end of each of the plurality of gate drivers and a gate turn-off voltage, and a gate pulse modulation circuit that outputs the gate driving signal, and wherein, when the chamfering of the gate driving signal is performed, the gate driving circuit is simultaneously discharged through the first discharge circuit and the second discharge circuit.

10. The method of claim 9, wherein a resistance value of the second discharge circuit exceeds a resistance value of the first discharge circuit.

11. The method of claim 10, wherein each of the plurality of gate drivers further comprises a precharge switch coupled between a gate turn-on voltage and the discharge end of each of the plurality of gate drivers.

12. The method of claim 11, wherein when the gate driving circuit controls the precharge switch to close, the gate driving circuit is discharged through the first discharge circuit and the gate turn-on voltage precharges a parasitic capacitance of an equivalent resistance formed between two adjacent discharge ends of the plurality of gate drivers.

13. The method of claim 12, wherein the second discharge circuit further comprises a discharge control switch, and wherein when the gate driving circuit performs the chamfering of the gate signal, the discharge control switch is closed.

14. A display device comprising:

a display panel; and a gate driving circuit outputted a gate driving signal to the display panel, and wherein the gate driving circuit comprising: a first discharge circuit;

a plurality of interconnected gate drivers, wherein the plurality of gate drivers is electrically coupled to ground through the first discharge circuit, and wherein each of the plurality of gate drivers comprises a second discharge circuit, coupled between a discharge end of each of the plurality of gate drivers and a gate turn-off voltage, and a gate pulse modulation circuit that outputs a gate signal; and wherein when the gate driving circuit performs a chamfering of the gate signal, the gate driving circuit is simultaneously discharged through the first discharge circuit and the second discharge circuits.

15. The display device of claim 14, wherein a resistance value of the second discharge circuit exceeds a resistance value of the first discharge circuit.

16. The display device of claim 15, wherein each of the plurality of gate drivers further comprises a precharge switch coupled between a gate turn-on voltage and the discharge end of each of the plurality of gate drivers.

17. The display device of claim 16, wherein the plurality of interconnected gate drivers is through an electrically-conductive line.

18. The display device of claim 17, wherein when the gate driving circuit controls the precharge switch to close, the gate driving circuit is discharged through the first discharge circuit and the gate turn-on voltage VGH precharges a parasitic capacitance of an equivalent resistance formed by the electrically-conductive line between two adjacent discharge ends of the plurality of gate drivers.

19. The display device of claim 18, wherein the second discharge circuit further comprises a discharge control switch, and wherein when the gate driving circuit performs the chamfering of the gate signal, the discharge control switch is closed.

* * * * *